United States Patent [19]

Damiron et al.

[11] Patent Number: 4,762,599

[45] Date of Patent: Aug. 9, 1988

[54] PROCESS AND PLANT FOR AN ELECTROLYTIC TREATMENT OF A METAL STRIP

[75] Inventors: Pierre-Marie Damiron, Neuilly; Jean-Luc Le Goupil, Paris; Pascal Ménage, Rueil Malmaison, all of France

[73] Assignee: Clecim, Courbevoie Cedex, France

[21] Appl. No.: 948,196

[22] Filed: Dec. 31, 1986

[30] Foreign Application Priority Data

Oct. 20, 1986 [EP] European Pat. Off. ..... 86402354.4

[51] Int. Cl.[4] ..... C25F 1/04

[52] U.S. Cl. ..... 204/144.5; 204/28; 204/141.5; 204/206; 204/224 R

[58] Field of Search ..... 204/28, 129.1, 129.43, 204/129.5, 129.65, 141.5, 144.5, 145 R, 206, 207, 208, 209, 210, 211, 224 R

[56] References Cited

U.S. PATENT DOCUMENTS

| | | | |
|---|---|---|---|
| 3,374,159 | 3/1968 | Poole | 204/143 |
| 3,420,760 | 1/1969 | Freedman | 204/145 |
| 4,441,975 | 4/1984 | Carter et al. | 204/206 |

OTHER PUBLICATIONS

F. A. Lowenheim, *Electroplating*, McGraw-Hill Book Co., New York, 1978, pp. 78–79.

*Primary Examiner*—John F. Niebling
*Assistant Examiner*—William T. Leader
*Attorney, Agent, or Firm*—Pollock, Vande Sande & Priddy

[57] ABSTRACT

A plant for electrolytic surface treatment and especially for descaling of a metal strip (2), comprising for the treatment of the same single face of the strip, at least two electrode-rolls (4) which are entirely immersed in a bath of electrolytic liquid and over which the strip passes. The rolls are covered with an insulating coating consisting of a series of spaced bearing rings centered in planes perpendicular to the axis of the roll and between which are provided annular treatment spaces, the bottom of which consists of a conductive wall, and the bearing rings are offset axially from one roll to another so that, in the direction of travel of the strip, the regions treated between the bearing rings of one roll correspond to the bearing regions on the rings of the succeeding roll, and vice versa. The plant can be applied, for example, to the cleaning, pickling or dechroming of a strip travelling at a high speed.

19 Claims, 5 Drawing Sheets

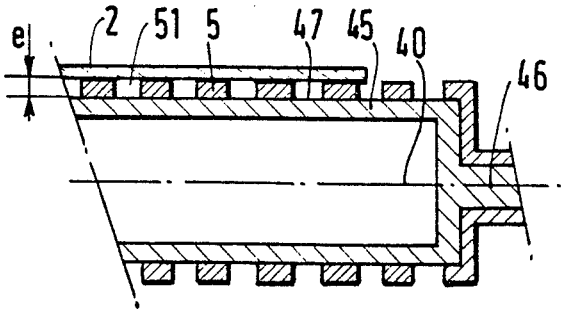
FIG. 2
FIG. 3
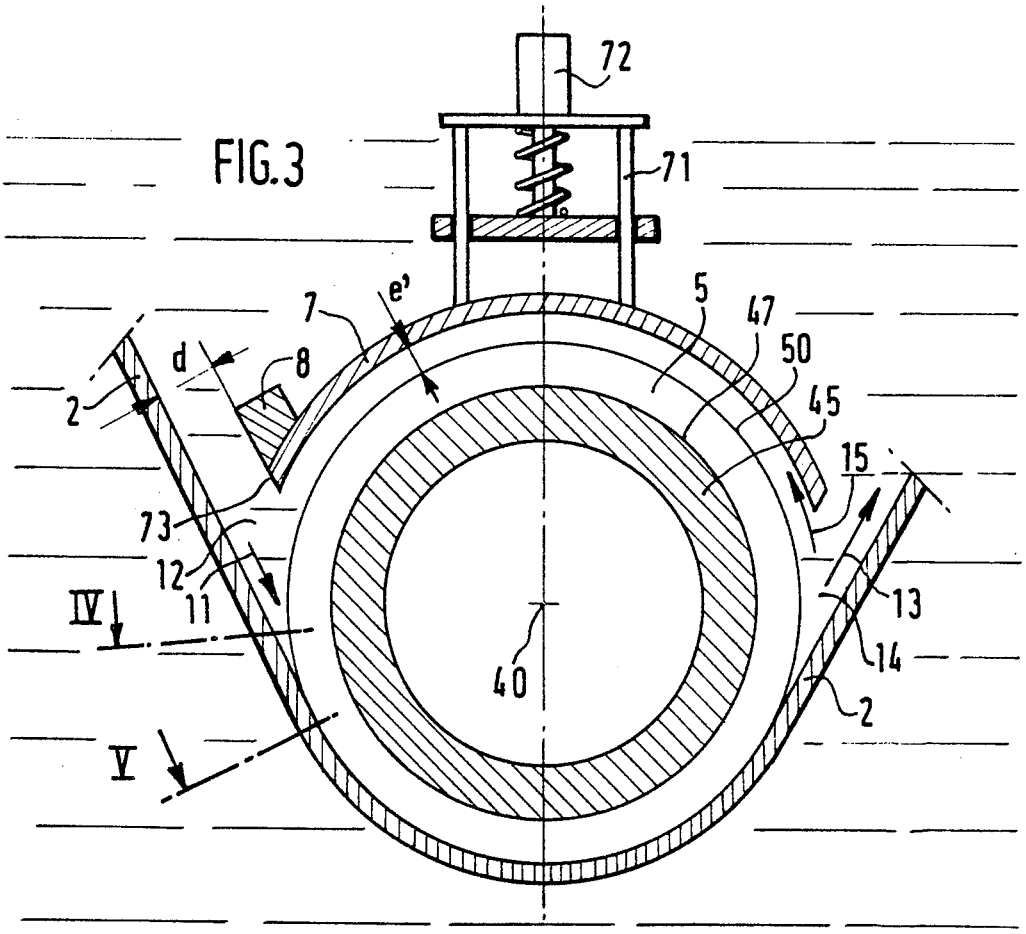

PROCESS AND PLANT FOR AN ELECTROLYTIC TREATMENT OF A METAL STRIP

FIELD OF THE INVENTION

The invention relates to a process for the electrolytic surface treatment of a metal strip travelling at a high speed, the effect of which is to detach or dissolve a film from the surface of the strip for example for cleaning, pickling or dechroming, and also covers the treatment plants for implementing the process.

BACKGROUND OF THE INVENTION

Many plants for electrolytic treatment of metal strips are known, in which the strip is caused to travel at a high speed in front of an electrode placed at a certain distance from the strip, while an electrolytic liquid fills the space between the strip and the electrode. By placing the strip and the electrode at different potentials, an electric current may be passed through the space filled with the electrolytic liquid to produce an electrolysis effect. In some plants used for pickling or cleaning metal strips, this electrolysis effect produces a release of bubbles which promotes the detachment of a surface film from the strip.

To enable the electrolysis to be carried out under proper conditions, the gap between the strip and the electrode, through which the electric current passes, must be as narrow as possible but, in the event of a fault in the tension drive or bad flatness of the strip, the latter may come into frictional contact with the surface of the facing electrode, and this may cause damage to the strip and/or the electrodes.

In some known plants, in order to maintain the strip in a constant distance from the electrode, the latter consists of a roll placed in contact with the strip. The roll consists on its periphery of a conductive wall covered with a noncontinuous insulating coating of a constant thickness, in which recesses are provided, so that the entire surface of the roll consists of bearing sections of a constant height, which are separated from each other by spaces allowing the conductive wall of the roll to be seen; the electrolytic liquid is injected into the spaces provided in this way to produce the electrolysis between the strip and the conductive wall of the roll, which are at different potentials. In these known plants, the electrode-roll is always placed outside the electrolytic bath. In some cases, the liquid is conveyed directly from the bath to the electrode roll by the previously submerged strip or by a carrier roll dipped in the bath and placed in contact with the electrode-roll. In other cases, the strip passes over rolls which are offset in height and define a zigzag path, the liquid being injected into the dihedrally-shaped spaces provided between the upstream length of the strip and each roll.

Arrangements of this kind do not permit a large quantity of liquid to be conveyed onto the electrode-roll, nor to be removed from the latter, which would be particularly useful in the case of a pickling or cleaning or dechroming treatment.

In addition, it is not easy, without making the plant more complex, to obtain a homogeneous effect of the treatment in the direction of travel, nor to carry out the treatment on both faces.

Lastly, the speed of travel is relatively limited because, commencing at a certain speed, a lateral floating of the strip may take place, which is due to what is known as the aquaplaning effect, which makes it difficult to guide the strip and disturbs the transverse homogeneity of the treatment.

SUMMARY OF THE INVENTION

The object of the invention is to overcome such disadvantages.

The plant for the treatment of metal strips according to the invention is of the type comprising a bath of electrolytic liquid and means for controlling the passage of the strip over at least one electrode-roll mounted in rotation around an axis perpendicular to the direction of travel and limited by a conductive wall partially covered with an insulating coating consisting of bearing parts of uniform height which are separated by recesses whose bottom consists of the conductive wall and capable of being filled with electrolytic liquid originating from the bath and introduced between the strip and the roll, and means for controlling the flow of an electric current between the strip and the conductive wall of the roll.

In accordance with the invention, the plant comprises, for treating the same single face of the strip, at least two electrode-rolls entirely submerged within the electrolytic liquid bath and whose insulating coating consists of a series of spaced bearing rings centered in planes which are perpendicular to the axis of the roll and between which annular treatment spaces are provided, whose bottom consists of the conductive wall, the said rings being offset axially from one roll to another so that, in the direction of travel of the strip, the treated regions between the bearing rings of one roll correspond to the bearing regions on the rings of a succeeding roll, and vice versa.

In the plant according to the invention, the treatment is thus carried out within the bath itself and, as a result, it is easy, if desired, to treat both faces of the strip in a single operation and, in addition, the liquid circulates at a high flow rate in the annular treatment spaces, and this is especially advantageous in the case of a pickling treatment, in order to remove the detached particles quickly.

Furthermore, in the case of a cleaning plant, the formation of foam is considerably limited due to the immersion of the treatment rolls.

According to another feature of the invention, at least some of the gas produced by electrolysis is entrained and maintained in the stream of liquid travelling between the strip and the roll and various devices for controlling the proportion of the gas entrained as a function of the speed of travel are provided, so as to make the liquid fairly compressible, to prevent the detachment of the strip at this speed. In this manner, the aquaplaning effect which usually occurs at high speeds may be brought under complete control and there is no longer any risk of the band floating, the latter remaining applied to the roll at a constant distance which is equal to the thickness of the bearing rings, even at a very high speed, by virtue of the control of the compressibility of the liquid.

At least one of the rolls defining the passage circuit can be an ordinary deflecting roll, submerged or not, if the number and places of the submerged electrode rolls are determined so as to avoid the band floating.

According to another feature of the invention, the treatment of each face of the strip is produced by parallel bands which are spaced apart and travel alternately over the annular spaces of one roll and then of the other. The offset of the rings may, in fact, be adjusted so that the bands formed on two successive rolls are adjoining, and this makes it possible to perform the treatment of one complete face by passing over two rolls. Furthermore, since there is no band floating, the treatment is performed in a homogeneous mannr in the transverse direction. The rolls need no longer be placed in an angular position relative to each other, nor does their number need to be incrased to obtain a homogeneous treatment in the lengthwise direction, and the lengthwise slippages which may be produced, especially during the acceleration and braking stages, do not present the risk of affecting the uniformity of the treatment, either.

In a first embodiment for the simultaneous treatment of both faces of a strip, the plant comprises an even number of rolls, with at least one face of the strip passing over two neighboring rolls. These rolls may define, for example, an inverted T-shaped passage circuit determined by two pairs of electrode-rolls which are set apart and placed at two different heights, each face of the strip being treated by a pair of electrode-rolls.

In a second embodiment for the simultaneous treatment of both faces of a strip, the plant comprises an odd number of submerged electrode-rolls defining a zigzag passage circuit, the strip being applied alternatively on one face and then on the other.

Advantageously, two neighboring electrode-rolls are connected, respectively, to two terminals of an electricity supply circuit which are at different potentials, with the result that the electric current is conducted by the strip itself between the said neighboring rolls.

It may also be useful for the electric supply circuit to include an inverter capable of changing the polarity of the rolls at regular intervals.

In a particularly advantageous embodiment, each submerged electrode-roll is covered, on the section of its periphery which is not covered by the strip, by a hood in the shape of a circular sector parallel to the outer wall of the roll and held separated by a small distance from the latter.

According to another advantageous characteristic, each roll is associated with an auxiliary electrode placed upstream of the roll in the direction of travel of the strip which is separated from this electrode and/or from the roll by a sufficient distance to avoid the risk of rubbing, but nevertheless to cause the release of a certain quantity of gas which is entrained with the liquid between the strip and the roll so as to regulate the compressibility of the liquid in this space.

This auxiliary electrode may consist of a plane electrode arranged parallel to the strip at a small distance from the latter, in the region of close approach, and having the same polarity as the roll. This electrode may be associated with the hood described earlier so that their effects may be combined.

Lastly, in another advantageous embodiment, the hood itself may form an auxiliary electrode. It is then made of a conductive metal, at least on its side facing the roll, and is connected to the electric circuit so as to be at an opposite polarity to that of the roll with which it is associated.

According to an additional characteristic, the hood is mounted so that it can slide radially and is associated with means for adjustment of its distance relative to the roll.

By virtue of this set of characteristics which can be used individually or in combination, the plant according to the invention makes it possible to carry out electrolytic cleaning, pickling or dechroming and, in general, any treatment for removing a film on one or two faces of the strip, at very high speeds of travel which can go up to 1500 m/min.

The invention will be better understood from the following description of several embodiments which are given by way of example and shown in the attached drawings.

FIG. 2 is a partial section of a roll through an axial plane;

FIG. 3 is a section of a roll through a plane at right angles to the axis;

DESCRIPTION OF PREFERRED EMBODIMENT

Figure 1:
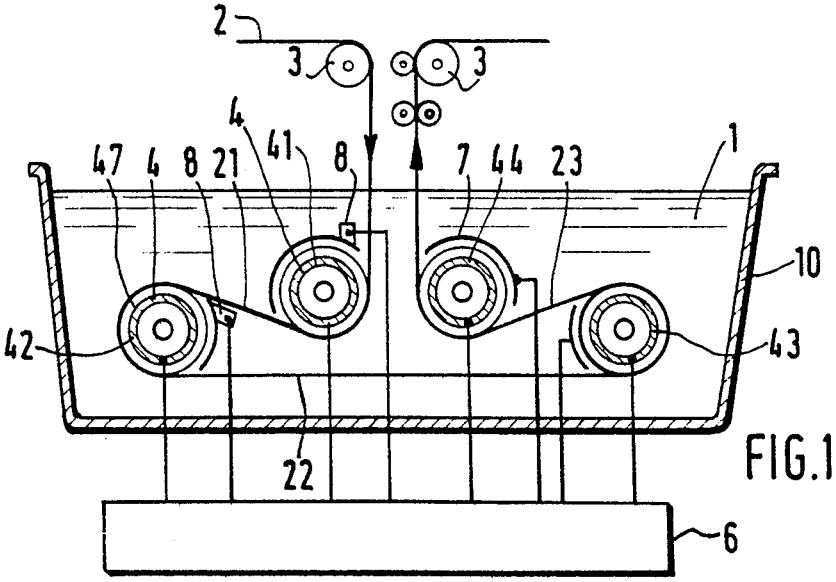
FIG. 1 shows diagrammatically a plant in a first way of arranging the rolls.

FIG. 1 shows a first embodiment of the plant, which comprises a bath of electrolytic liquid 1 held in a vessel 10 and through which a metal strip 2 passes at a high speed. The external circuit comprising, for example, a reel from which the strip unwinds and rewinding means placed downstream of the vessel are not shown in the drawings.

The passage circuit of the strip 2 in the bath 1 is limited, externally, by deflecting rolls 3 and, within the bath, according to one of the essential characteristics of the invention, by the electrode-rolls 4.

The electrode-rolls 4 and, if applicable, other parts of the plant, are connected to an electricity supply circuit 6 so that, on each roll, there is a specified potential difference between the face of the strip 2 wound onto the roll and the outer face 47 of the roll situated opposite.

For obvious safety reasons, at the entry and exit of the plant, the strip passes over earthed conductive rolls (not shown).

As a general rule, the electric connection method depends on the arrangement of the electrode-rolls and on the path of the strip, as well as on the treatment process which is to be carried out. For this reason, Fig. 1 shows the electric circuit 6 only diagrammatically, while FIGS. 6 to 10 indicate, by way of example, particularly advantageous methods of connection.

In the embodiment of FIG. 1 the passage circuit has an inverted T shape defined by two pairs of electrodrolls (41,44) and (42,43) submerged at two different depths in the bath. The rolls 41 and 44, placed at the higher depth, are close to each other, whereas the rolls 42 and 43, placed at a lower depth, are set apart.

The inverted T arrangement is not the only one which could be employed, and an inverted U circuit for example could be produced, the strip being passed over rolls placed at different depths.

The submerged rolls are mounted on shafts which pass through the side walls of the trough so that leakproofing is maintained, it being possible for the bearings and electricity supply brushes to be situated outside the trough. If necessary, the rolls may be driven at a speed which is synchronized with the speed of travel of the strip.

FIG. 2 and 3 show an electrode-roll in an axial section and in cross-section respectively.

Each electrode-roll consists of a cylindrical wall 45 carried at its ends by two shafts 46 housed in bearings (not shown) and defining an axis of rotation 40. The cylindrical wall 45 is entirely made of or else covered with a conductive metal and may be connected in a conventional manner, by means of brushes, to an electric circuit 6 so that its outer cylindrical face 47 may be at a certain electric potential.

In addition, on its periphery the roll is covered by a series of rings 15 centered in planes perpendicular to the axis 40 and separated from each other so as to provide circular spaces 51 between them, the bottom of which consists of the outer face 47 of the roll.

The strip 2 winds over an angular sector of the periphery of the roll, being applied to the top of the rings 5, the latter having the same height so as to maintain between the strip 2 and the conductive face 47 of the roll a constant gap of width e, for example between 3 and 30 mm.

At each electrode-roll 4, the flow of current between the conductive face 47 of the roll and the facing side of the strip 2 produces a release of gas on the latter, which detaches from it particles of oil, grease, scale, chrome and, in general, any other particle or film with which it may be covered, effecting thereby the cleaning, pickling or dechroming of this side.

Understandably, on each electrode-roll 4, the treatment is carried out only on the separate bands corresponding to the spaces between the strip bearing rings, the portions of the strip bearing on the rings being untreated. To produce a complete treatment of the two faces of the strip, each face will therefore be passed over at least two rolls whose rings 5 will be offset axially from each other so that the bands treated on the first roll are bearing on the rings of the second roller and vice versa.

It will be noted that when carrying out the treatment in continuous bands which are separated and offset between one roll and another, it suffices to make the strip pass over two rolls to produce a complete treatment of the same single face, the offsetting of the rings being regular and easy to adjust, in order that the bands are at least joined so that the applied treatment is uniform in the transversal direction of the passage. Furthermore, there is no need to place the rolls in an angular position relative to each other or to multiply the number of rollers to obtain a uniform treatment in the passage direction and this uniformity is no more affected by lengthwise slippage which may be produced during the acceleration or braking stages.

The particles which are detached in this manner are immediately removed in the bath by virtue of the circulation of the electrolytic liquid which is established in the spaces 51 between the rings 5, according to an essential feature of the invention. In fact, since the roll is completely submerged in the bath, the electrolytic liquid is readily entrained, in the direction of the arrow 11 by the passage of the strip 2 and the rotation of the roll in the region 12 where the strip approaches, shaping a dihedron limited on one side by the upstream length of the strip and on the other by the circular wall of the roll, and it then circulates in the spaces 51 between the rolls to be tangentially ejected, in the direction of the arrows 13, in the region 14 where the strip moves away. As shown diagrammatically in FIGS. 4 and 5, which show the position of the strip before and after the contact, the electrolytic liquid 1 is entrained into a space whose width decreases gradually as far as the height e of the rings 5. Contrary to expectations, according to another essential feature of the invention, this constriction of the space in which the electrolytic liquid travels does not cause the strip to be detached as a result of the pressure increase which is produced thereby.

In fact, at least some of the released gas produced by the electrolysis on the side of the strip facing the roll is entrained between the strip and the roll by the moving stream of liquid. A certain number of bubbles 15 are therefore distributed in the liquid, in a proportion which depends on the magnitude of the electrolytic effect, the polarity of the strip relative to the roll and the speed at which the strip travels past.

Figure 4:
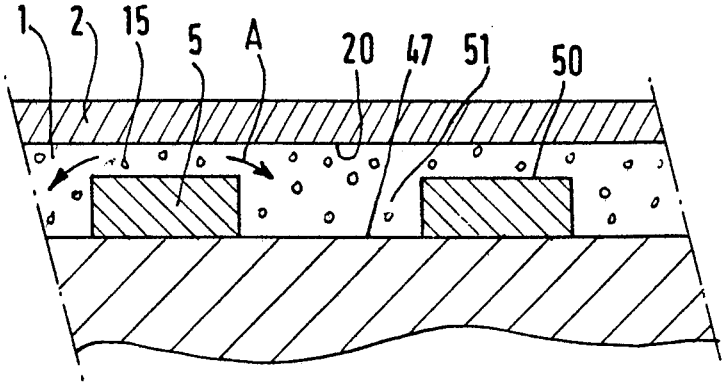
FIGS. 4 and 5 are detailed, enlarged-scale views in cross-section through radial planes along lines IV and V of FIG. 3.
Figure 5:
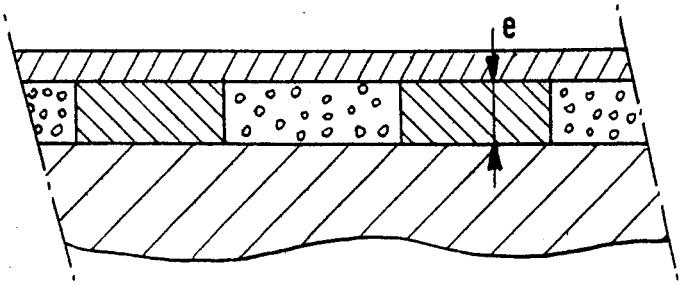

This proportion of bubbles 15 makes the liquid 1 compressible, consequently enabling it to be removed sideways, along the arrows A in FIG. 4, towards the spaces 51, as the strip face 20 approaches the outer face 50 of the rings; when the proportion of bubbles present in the fluid enables the latter to become compressible enough, then it becomes possible to reach a state in which a residual film capable of producing the "aquaplaning" phenomenon is no longer present between the strip 2 and the rings 5, which makes it possible to accomplish the very high speed treatment without risking the difficulty indicated above.

The quantity of gas which is entrained with the liquid can be controlled by different means which enable the regulation of the proportion of the bubbles in the liquid while maintaining a constant speed of travel and/or strength of the electrolysis current.

A first means for obtaining uniformity consists of a hood 7 in the shape of a circular sector centered on the axis 40 of the roll, surrounding the sector of the latter which is not covered by the metal strip 2 and separated from the outer face 50 of the insulating rings by an adjustable distance (e').

To this end, the hood 7 is mounted so that it can slide in a radial direction on a carrier 71 comprising a means 72 such as a mechanical, pneumatic or hydraulic jack which makes it possible to adjust the distance of the hood 7 in relation to the axis 40 and, consequently, the gap (e') between the inner face of the hood and the outer face 50 of the rings 5.

On leaving the spaces 51, in the region 14 where the strip 2 moves away, the relatively dense particles detached from the strip are removed tangentially in the direction of the arrows 13, but the gas bubbles, which are light and distributed uniformly in the electrolyte, are partly diverted by the hood 7 in the direction of the arrows 15 and are recycled into the approach region 12 of the strip 2. Thus, by adjusting the position of the hood 7, it is possible to control the recycling of the bubbles in the upstream region 12 and, depending on the quantity of the gas produced by the electrolysis, to attain an equlibrium in the proportion of gas so as to endow the fluid present in the spaces 51 with the required degree of compressibility.

Furthermore, another arrangement according to the invention enables the proportion of bubbles produced to be increased. For this purpose, the plane electrodes 8, shaped like a ruler, which extend over at least a part of the width of the strip, are placed in the approach region 12, preferably along the edge 73 of the hood 7 facing the upstream length in the direction of travel, and are connected to the electric circuit 6 so as to be at a potential which is different from that of the strip. The electrodes 8, represented on the left side of FIG. 1, are separated from the strip by a sufficiently large distance to avoid any risk of frictional contact, for example in the event of a fault in the tension drive or bad strip flatness. This distance may not be sufficiently reduced to achieve a pickling or cleaning or dechroming action, but it nevertheless makes it possible to produce on the strip and on the electrodes 8 a certain number of bubbles which are entrained by the liquid towards the electrode-roll and are therefore added to the bubbles produced on the facing side of the electrode roll.

However, it is also possible to use the hood 7 itself to produce an additional gas release, as shown on the right-hand side of FIG. 1.

In this case, at least the hood 7 side facing the roll needs to be made of a conductive metal and to be connected to the electric circuit 6 so as to be at a potential which is different from that of the electrode-roll with which the hood is associated. An electrolysis effect is then produced between the hood 7 and the electrode-roll, with formation of bubbles which are entrained by the roll and, as previously, are added to the bubbles produced by the electrolysis between the strip and the roll.

A number of means are thus available, enabling the proportion of the bubbles present in the spaces 51 and, hence, the compressibility of the fluid to be adjusted accurately and, using means which are easily imagined, it is possible to achieve a control and an optimization of the quantity of gas present in the treatment region as a function of the various characteristics of the plant.

It will be noted that, according to one of the characteristics of the invention, the electrolytic currents may be emitted or picked up only at the electrode-rolls, apart from the earthing rolls which are placed upstream and downstream of the electrolytic process section.

In this manner, no direct contact ever takes place between the strip and the conductor. In particular, in contrast to certain known arrangements making use of electrode-rolls, for example for coating strips, the use of conductive rolls for causing the current to flow is avoided, and hence the possibility of occurrence, at these, of electric arcs which are detrimental to the lifespan of the said rolls and to the quality of the strip.

The nature and the quantity of gas produced by electrolysis depend, furthermore, on each electrode-roll, on the relative polarities of the strip, rolls and auxiliary electrodes, and, according to another characteristic of the invention, it is advantageous to provide in the supply circuit 6 one or more inverters permitting the direction of the electrolysis current between each roll and the facing side of the strip to be reversed at regular intervals.

This makes it possible, in a known manner, to avoid fouling of the electrodes, which would be reflected in an increase in the voltage at constant current, but this reversal of the current direction at regular intervals offers, within the scope of the invention, specific advantages which will be described later.

Various methods of connection may be adopted, depending on the number of rolls, the travel path and the required effects. Various examples of possible circuits are shown in FIGS. 6 to 10.

Figure 6:
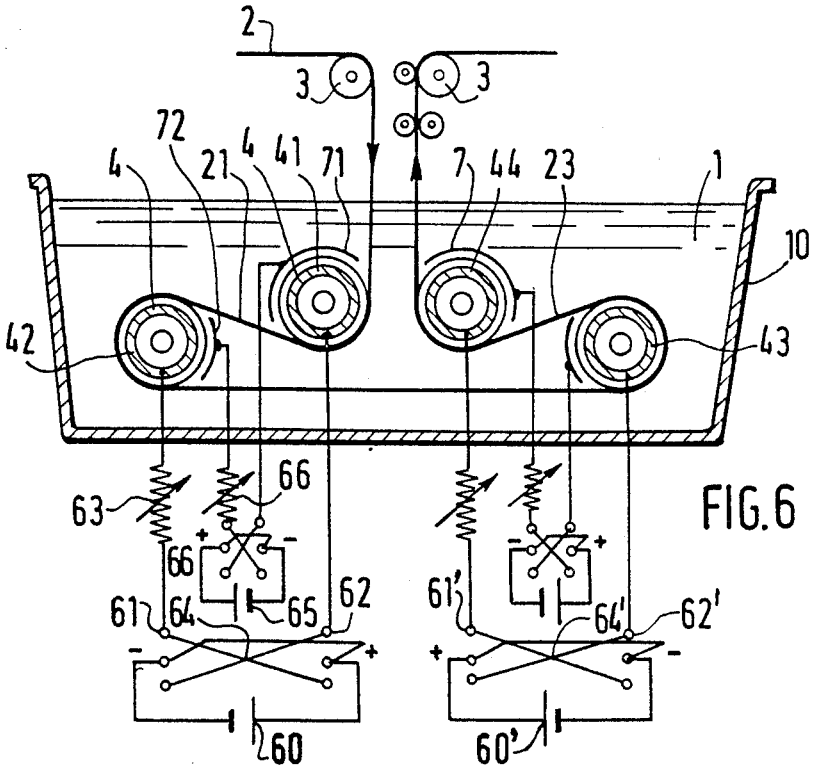
FIGS. 6, 7, 8, 9 and 10 show, respectively, various arrangements and of electricity supply to the rolls.

In FIG. 6 the inverted T arrangement of FIG. 1 has been chosen, each electrode-roll being associated with a conductive hood.

The electrode-rolls are associated in pairs of neighbouring rolls, 41 and 42 on one side, 43 and 44 on the other, both rolls of each pair being connected to two opposite terminals 61, 62, 61', 62' of a generator, 60, 60' respectively, via an inverter 64, 64'. As a result, in each pair, one roll operates as an anode and the other as a cathode, the face of the strip in contact with the roller being opposite in polarity. From the terminal 62 of the generator 60, the electric current flows from the conductive face 47 of the electrode-roll 41 to the part of the strip 2 wound onto the roll, passing through the electrolytic liquid, and then circulates in the short length 21 of the strip between the rolls 41 and 42 and again passes through the space filled with electrolyte included between the part of the strip 2 which is wound ono the roll 42, which part then operates as an anode, and the conductive face of the roll 42, connected to the terminal 61, which operates as a cathode.

The strength of the electrolysis current may be regulated by adjusting a variable resistor 63 or alternatively, the voltage delivered by the generator 60.

The rolls 43 and 44 are connected to the generator 60' in the same manner.

In this circuit, one face of the strip is treated by the rollers 41 and 44, and the other face by the rolls 42 and 43, and the rolls treating the same face operate either as an anode or as a cathode so that each whole face is subjected to the same gas release. If both faces of the strip are intended to be subjected to the same treatment, then the rolls treating the same face may be connected to opposite polarities and/or the current direction may be reversed at regular intervals by virtue of the inverters 64, 64', in the manner indicated above.

Each electrode-roll is associated with a conductive hood and, according to another advantageous feature, the hoods 7 may be supplied with a voltage which can be regulated independently of those which are applied to the rolls. Thus, in the embodiment shown in FIG. 6 the hoods 71 and 72, associated with the roll 41, 42, are connected to two terminals of a generator 65, the current passing from one to the other via the electrolyte, the electrode rolls 41 and 42 and the length 21. This is also done at the other side of the plant. The current strength may be regulated by a variable resistor 66' or by adjusting the voltage supplied by the generator 65'.

In this manner, the strengths of the electrolysis currents on each electrode-roll can be regulated independently, making it possible respectively, to accomplish the pickling or cleaning or dechroming process and to control the effect of strip floating by regulating the number of bubbles present in the circulating liquid, it being also possible to regulate their number by adjusting the position of the hood. It can be seen, therefore, that a large number of means of control are available, whose effects may be combined so that it becomes possible to regulate the quantity of gas circulating on each roll, in order to moderate the "aquaplaning" effect without altering the efficiency of the process.

The supply circuits of the conductive hoods are also provided with inverters, whose operation may be synchronized with that of the main circuit supplying the electrode-rolls.

Figure 7:
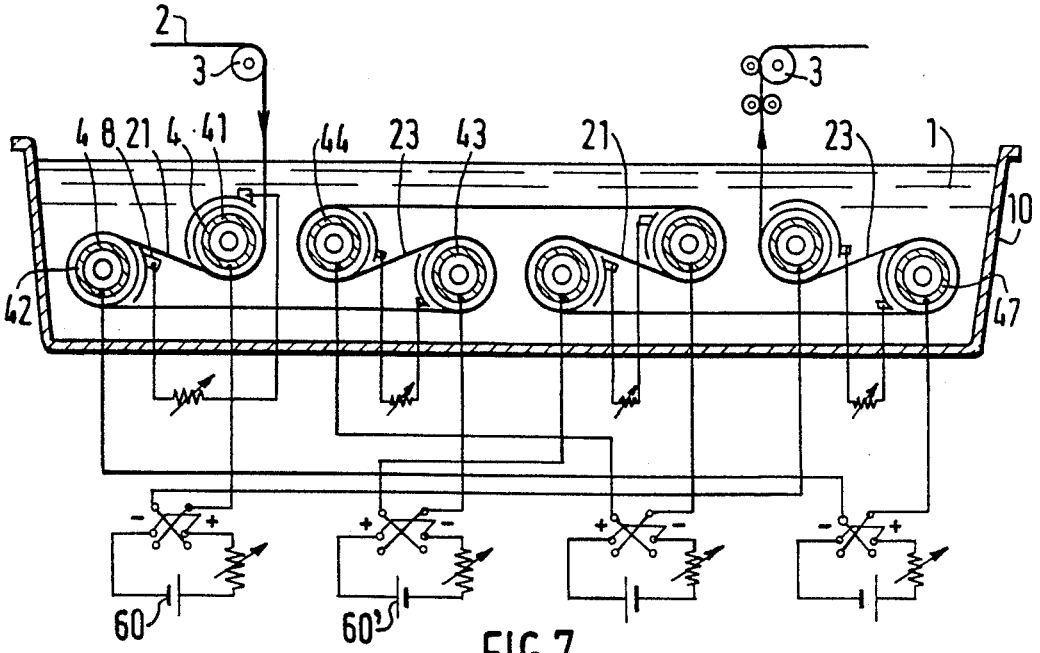

The plant may be further realized, as shown in FIG. 7, by associating several sets of rolls in succession. In this case, for example, each roll is associated with a plane electrode 8 for producing an additional quantity of gas, which is itself placed on the edge of a hood for regulating the flow of reinjected gas.

FIG. 7 also shows another connection method using several generators whose terminals are connected to rolls belonging to different pairs. In a manner which is also advantageous, the auxiliary electrodes may be merely connected to each other so that they work together in circulating the electric current, while a variable resistor permits the current flowing through the hoods to be regulated, to control the "aquaplaning" effect.

Figure 8:
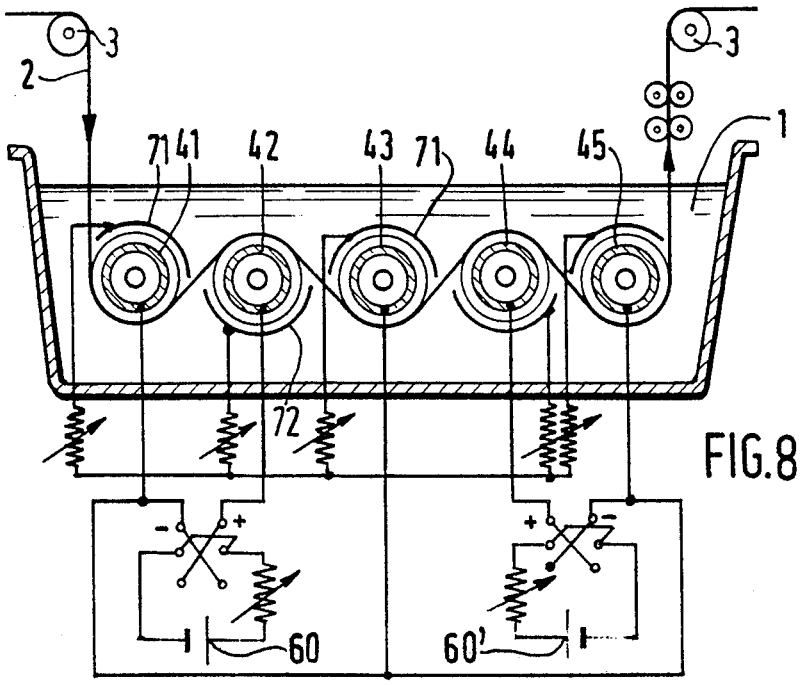

FIG. 8 shows another way of arranging the rolls inside the bath 1. In this case, an odd number of rolls are used, which are placed at the same depth in the bath is desired and onto which one face of the strip and then the other are wound alternately, following a zigzag path. This arrangement of the rolls can also be connected in many ways. For example, in the embodiment of FIG. 8, the supply circuit comprises two generators, each connected to a set of three rolls, and the auxiliary electrodes consisting, for example, in the case of each roll, of a conductive hood, are merely connected together by a common circuit comprising a variable resistor for adjusting strength in the case of each auxiliary electrode. In this manner, taking roll 42 as an example, some of the current produced by the generator 60 flows over the associated hood 72 and returns via the corresponding hoods 71 on the rolls 41 and 43, while most of the current flows from the roll 42 to the corresponding face of the strip and from the other face on the rolls 41 and 43, giving rise to the treatment.

Figure 9:
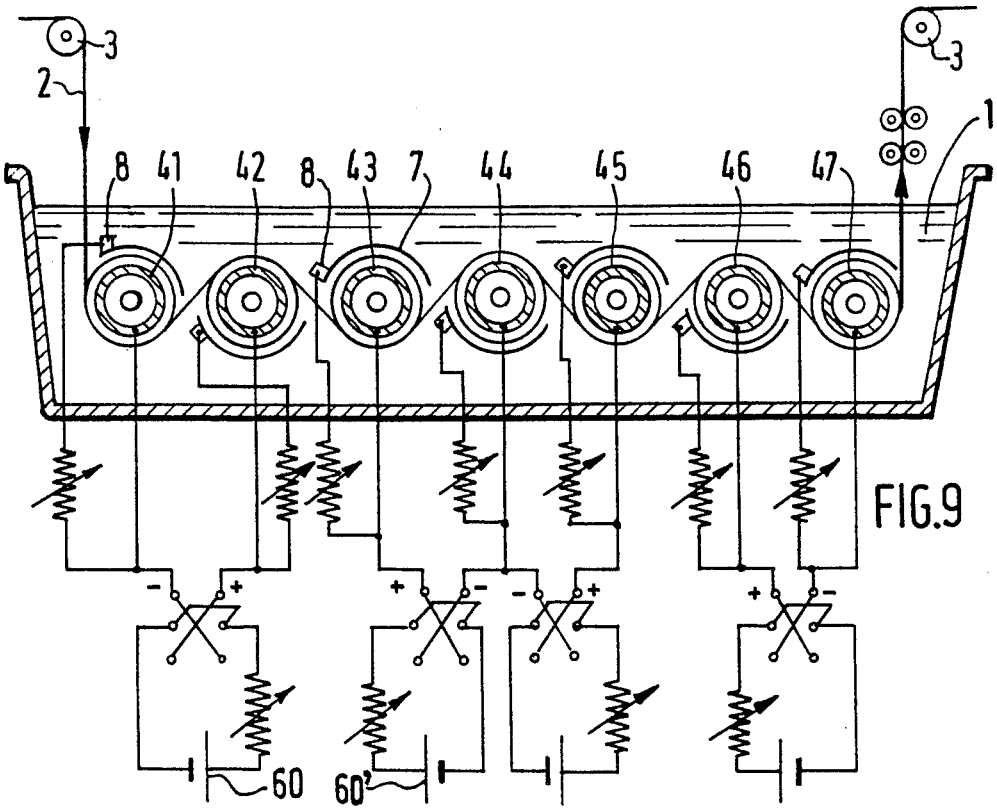

FIG. 9 shows a plant having a larger number of rolls with anther connection method, each auxiliary electrode 8 being connected to the circuit supplying the associated roll via a variable resistor, enabling the added quantity of gas to be regulated without altering the strength of the electrolysis current producing the treatment.

Figure 10:
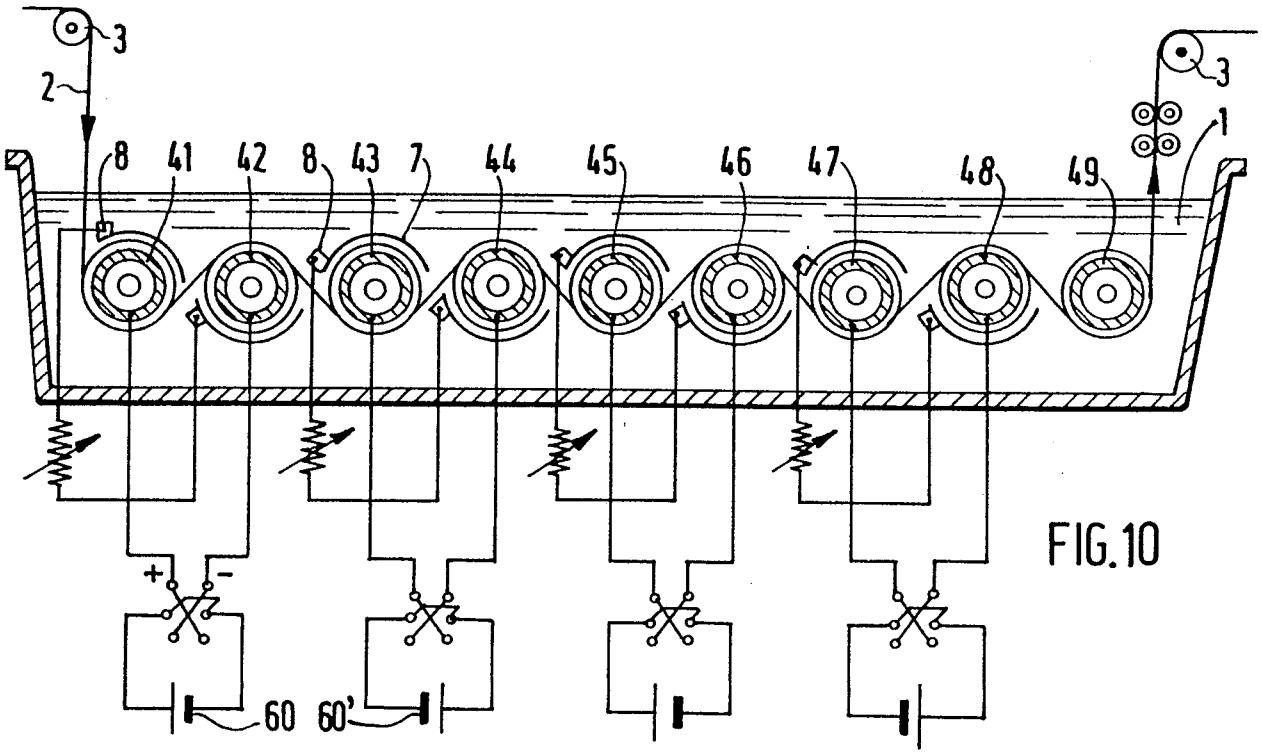

In the plant with nine rolls, which is shown in FIG. 10, the last roll 49 of the series is not an electrode-roll but merely a deflecting roll. The electrode-rolls are connected in pairs of adjacent rolls, namely, 41 and 42, 43 and 44, and so on, to separate generators 60, 60', and so on, whose polarities are reversed between one pair and the following so that two adjacent rolls connected to different generators, such as 42 and 43, 44 and 45, and so on, are of the same polarity.

As has been indicated, it is advantageous, in the different circuits which have just been described, for each generator, such as 60, 60' and the like, to be connected to the corresponding electrode-roll via an inverter. In fact, since each electrode roll with circular rings treats one half-face at a time, as separated strips, it is possible, by reversing the current direction at regular intervals, to cause oxygen or hydrogen to be released on each half-face of the strip in a proportion corresponding to the period during which the face of the strip is an anode or cathode, respectively.

In this way, it will become possible to treat each half-face with both gases in a predetermined ratio and to make use of the fact that the effect of the current produced by electrolysis depends on the direction of the current.

This arrangement will, futhermore, give rise to pulsed currents in the strip, so as to improve the treatment.

In practice, the frequency of reversal of the current direction will thus depend on the proportions of gas which it is intended to produce, and will be controlled by the speed of travel of the strip. This frequency will be much higher than that traditionally employed to avoid the fouling of the electrodes.

In a first, particularly advantageous embodiment, a period ($t_A$) of operation of an electrode-roll as an anode is followed by a period ($t_c$) of operation of the same roll as a cathode, the total of both these periods being exactly equal to the time (t) of residence of the strip on the electrode-roll, which, by definition, is equal to the quotient of the length (L) of strip wound around the electrode-roll, divided by the speed (V) of travel of the strip.

This sequence, consisting of a time ($t_A$) of operation of the electrode roller as an anode and a time ($t_c$) of operation as a cathode, is repeated so as to form a continuous, alternating series.

In this manner, a treatment is effected which is homogeneous in the lengthwise direction of the strips treated on the electrode-rolls, and a predetermined value of the ratio of the volumes of hydrogen and oxygen which are released on the strip may be obtained by imposing a predetermined value of the ratio (R) of the times ($t_A$) and $t_c$). In point of fact, if:

$$R=t_A/t_c$$

then:

$$t_A=R\cdot L/(1+R)V$$

and $$t_c=L/(1+R)V$$

It is thus found that these times ($t_A$) and $t_c$) depend on the speed V of travel of the strip and that the corresponding frequencies must be controlled by this speed V in accordance with the above formulae in order to maintain this ratio R constant.

In this manner, and for example in the case of FIG. 6, a predetermined value will be obtained for the ratio of the volumes of hydrogen and oxygen which are released at the face of the strip in contact with the rolls 41 and 44, and, for this same ratio and for the face of the strip in contact with the rolls 42 and 43, a reverse value will be obtained, the treatment being uniform for each of the faces of the strip.

In a particular embodiment, the operating times ($t_A$) and ($t_c$) are euqal, R being equal to 1. The same value of the ratio of the volumes of hydrogen and oxygen which are released at the strip is thus obtained at each electrode-roll, and this makes it possible, for example in the case of FIG. 6, to produce a uniform and identical treatment on both faces of the strip.

In another advantageous embodiment, the time $t_A$ of operation as an anode is equal to the time of the residence of the strip on each electrode-roll, i.e., L/V and the time $t_c$ of operation as a cathode is equal to the time of transfer of the strip between two given electrode-rolls, i.e. to the quotient L'/V of the length L' of the strip separating these two electrode-rolls, divided by the speed V of travel of the strip. In this manner, a treatment of the strips treated on the electrode-roll which is uniform in the lengthwise direction is once again produced.

For example, in the arrangement shown in FIG. 10, the transfer length L' taken into account will be equal to the length of the strip separating two successive rolls treating the same half-face, such as:

41 to 43 for one half of the upper face and 45 to 47 for other the half;

42 to 44 for one half of the lower face and 46 to 48 for the other half.

This arrangement will also make it possible to produce a uniform and identical treatment of both faces of the strip.

As a general rule, the direction and the intensity of the currents at each electrode-roll will be determined as a function of the conditions imposed by the chosen treatment process and will obviously have to be compatible from one roll to another, so that the current circulation is possible electrically, it being possible for the electrolytic current density to be between 1000 and 20,000 $A/m^2$.

In the embodiments of FIGS. 6 to 9, all the rolls placed in the bath form electrode-rollers, which make it possible, as already seen, to prevent floating of the strip.

However, it is not ruled out for a simple deflecting roll to be installed in the passage circuit, as in the case of FIG. 10, since the strip is held sufficiently by the other electrode-rolls to prevent any floating. In addition, in the embodiments with an odd number of rolls defining a zigzag path, the use of a simple deflecting roll, such as for example the middle roll 43 in the case of Fig. 8, makes it possible to make the strip travel over an even number of electrode-rolls and to carry out the treatment under conditions which are identical to those in a T circuit, as in the case of FIG. 6.

In the case of FIG. 9, the rolls 42, 45 and 47 could be merely deflecting rolls, one face of the strip being treated on the rolls 41 and 43, and the other face on the rolls 44 and 46.

It can be seen, therefore, that the invention lends itself to many combinations and that, by modifying the number of the rolls and their arrangement, the spacing of the hoods, the electric supply to the auxiliary electrodes, or the period for which each roll operates as an anode or as a cathode, it is possible to control the nature and the rate of gas release produced on each face of the strip and to adapt the effectiveness of the treatment as a function of the state of each face, depending on the requirement which is specific to each plant.

We claim:

1. Plant for the electrolytic surface treatment of a metal strip, comprising:

(a) a bath for electrolytic liquid, (b) means for determining the passage of said strip along a direction of travel into said bath, said means comprising a plurality of rolls each rotating around an axis perpendicular to the direction of travel of the strip;

(c) at least two of said rolls for the treatment of the same single face of the strip being entirely submerged within the bath of electrolytic liquid;

(d) said at least two submerged rolls each comprising on its periphery a cylindrical conductive wall partially covered by an insulating coating consisting of a series of uniformly spaced bearing rings of uniform height centered in planes perpendicular to the axis of the roll and which are separated by recesses providing annular treatment spaces, the bottom of which consist of said conductive wall;

(e) said bearing rings being offset axially from one roll to another so that, in the direction of travel of the strip, the regions treated between the bearing rings of the one roll correspond to the bearing regions on the rings of the succeeding roll, and vice versa, and (f) means for controlling the flow of an electric current between the strip and the conductive wall of each submerged roll.

2. Plant according to claim 1 comprising an odd number of rolls (4) defining a zigzag path, the strip being applied onto the rolls alternately on one face and then on the other.

3. Plant according to claim 1, comprising an even number of rolls (4), at least one face of the strip (2) passing over two adjacent rolls.

4. Plant according to claim 2 or 3 wherein at least two adjacent electrode-rolls are adapted to operate at different potentials, the electric current being conveyed by the strip (2) itself from one roll to the other.

5. Plant according to claim 2 or 3 wherein each submerged electrode-roll (4) is covered, over the portion of its periphery which is not covered by the strip, by a hood (7) in the shape of a circular sector parallel to the outer wall of the roll (4) and kept separated by a small distance (e') from this wall.

6. Plant according to claim 5 wherein the hood (7) is made of a conductive metal and is connected to the electric circuit (6) so as to form an electrode of a polarity opposite to that of the roll with which it is associated.

7. Plant according to claim 5, wherein the hood (7) is mounted to slide radially and is associated with means (72) for adjusting its distance relative to the roll (4).

8. Plant according to any one of claims 1, 2 and 3, wherein each electrode-roll (4) is associated with a plane electrode (8) arranged parallel to the strip (2) and at a small distance from the strip between the strip and the roll (4) in the region (12) of approach of the strip, said electrode (8) being connected to the electric circuit (6) so that the polarity is the same polarity as the roll (4).

9. Plant according to claim 8, further comprising a hood (7) having an edge (73) in the shape of a circular sector parallel to the outer wall of the roll (4) and separated by a small distance (e') from said wall and wherein the plane electrode (8) is placed along the edge (73) parallel to the strip (2) on the upstream side in relation to the roll (4).

10. Process for electrolytic treatment of a metal strip by passing within a bath of electrolytic liquid along a direction of travel defined by a plurality of rolls each rotating around an axis perpendicular to the direction of travel, at least two of said rolls being entirely submerged within the bath of electrolytic liquid and each constituting an electrode-roll comprising on its periphery a cylindrical conductive wall partially covered by an insulating coating consisting of a series of uniformly spaced bearing rings of uniform height centered in planes perpendicular to the axis of the rolls and which are separated by recesses providing annular treatment spaces, the bottom of which consist of said conductive wall, said electrode-rolls being connected to an electric supply circuit so that, at each roll, the strip and the conductive wall of the roll are at different potential, said treatment being produced in separate parallel bands by causing each face of the strip to be treated to pass over at least two submerged electrode-rolls the bearing rings of which are offset axially from one electrode-roll to the other so that, in the direction of travel of the strip, the lengthwise bands treated between the bearing rings of one roll correspond to the bearing regions on the rings of the succeeding roll and vice versa, at least some of the gas produced by electrolysis on the strip being mixed with the electrolytic liquid travelling in the treatment spaces between the rings.

11. Treatment process according to claim 10, wherein the proportion of gas produced by electrolysis and entrained with the liquid travelling between the strip and the roll is regulated as a function of the speed of passage, so as to make the liquid compressible enough to avoid the detachment of the strip at this speed.

12. Treatment process according to claim 11, wherein a part of the gas entrained with the liquid is produced by means of at least one auxiliary electrode associated with the electrode-roll, and the strengths of the electrolysis currents at the auxiliary electrode and at the electrode-roll are adjusted separately to maintain the required proportion of gas in the liquid.

13. Treatment process according to claim 12, wherein, in the region (12) where the strip approaches the roll, there is provided a plane auxiliary electrode (8) shaped like a ruler, extending over at least part of the width of the strip and having the same polarity as the roll.

14. Treatment process according to claim 11, wherein the roll (4) part which is not covered by the strip is surrounded by a hood (7) whose distance (e') relative to the roll (4) can be adjusted so as to maintain the required proportion of gas in the liquid circulating between the strip (2) and the roll (4).

15. Treatment process according to claim 14, wherein at least the hood (7) side facing the roll (4) is made of conductive metal and connected to the electric circuit (6) so as to form an auxiliary electrode having a polarity opposite to that of the roll.

16. Treatment process according to any one of claims 12, 13 and 16, wherein the electric circuit (6) is provided with at least one inverter (64) enabling the polarities of the rolls (4) and/or the auxiliary electrode (7, 8) to be reversed at regular intervals at a frequency controlled by the speed of passage of the strip (2).

17. Treatment process according to any one of claims 10 and 11 to 15, wherein a first plurality of electrode-rolls are operated at a first polarity and a second plurality of electrode-rolls are operated at the opposite polarity and wherein the operation of said first plurality of electrode-rolls consists of a continuous series of sequences which are identical to each other and each consisting of a time of operation as an anode $t_A=R-L/(1+R)V$ followed by a time $t_c=L/(1+R)V$ of operation as a cathode, where R is a positive number other than zero. L is the length of strip wound around each electroderoll, and V is the speed of travel of the strip, the operation of said second plurality of electrode-rolls of opposite polarity to said first plurality being reversed and synchronized with the first plurality, i.e., consisting of sequences commencing with a time of operation as a cathode $t_c=R\cdot L/(1+R)V$, followed by a time of operation as an anode $t_A=L/(1+R)V$.

18. Treatment process according to claim 17, wherein the number R is equal to 1.

19. Treatment process according to one of claims 10 and 11 to 15, wherein a first plurality of electrode-rolls are operated at a first polarity and a second plurality of electrode-rolls are operated at the opposite polarity and wherein the operation of said first plurality of electrode-rolls consists of a continuous series of sequences which are identical to each other and each consisting of a time of operation as an anode which is equal to L/V and a time of cathode operation equal to L'/V, where L is the length of strip wound around each electrode-roll, L' is a length of strip separating two given electrode-rolls, and V is the speed of travel of the strip, the operation of said second plurality of electrode-rolls of opposite polarity to said first plurality being reversed and synchronized with the first plurality i.e., consisting of sequences commencing with a time of cathode operation equal to L /V and ending with a time of anode operation equal to L'/V.

* * * * *

UNITED STATES PATENT AND TRADEMARK OFFICE

CERTIFICATE OF CORRECTION

PATENT NO. : 4,762,599

DATED : August 9, 1988

INVENTOR(S) : Damiron et al

It is certified that error appears in the above-identified patent and that said Letters Patent is hereby corrected as shown below:

Claim 16, line 2, change "16" to --15--.

Signed and Sealed this

Sixteenth Day of January, 1990

*Attest:*

JEFFREY M. SAMUELS

*Attesting Officer*

*Acting Commissioner of Patents and Trademarks*